United States Patent [19]

Waligore et al.

[11] 4,121,628

[45] Oct. 24, 1978

[54] SPRING FORMING MACHINE

[75] Inventors: Edward James Waligore, Walled Lake, Mich.; Francis X. Schuler, Freehold, N.J.

[73] Assignee: Lear Siegler, Inc., Berkley, Mich.

[21] Appl. No.: 790,374

[22] Filed: Apr. 25, 1977

[51] Int. Cl.[2] ..... B21F 35/04

[52] U.S. Cl. ..... 140/105

[58] Field of Search ..... 140/105, 140

[56] References Cited

U.S. PATENT DOCUMENTS

| | | | |
|---|---|---|---|
| 716,051 | 12/1902 | Kelly et al. | 140/140 |
| 2,331,294 | 10/1943 | Bank et al. | 140/105 |

*Primary Examiner*—Lowell A. Larson

*Attorney, Agent, or Firm*—Reising, Ethington, Barnard, Perry & Brooks

[57] ABSTRACT

A machine for forming wire from a continuous coil to provide springs having oppositely disposed loops includes a holder for locating the springs during operation of a cut-off mechanism and a guide for orienting and delivering the cut springs to a location remote from the cut-off mechanism. In one preferred embodiment that forms circular springs, the holder includes a downwardly inclined chute that positions the springs and the guide includes a conveyor onto which the springs roll from the chute as well as deflection plates for laying the springs down flat on the conveyor. In two other embodiments of the machine designed to form elongated springs, the holder of each has a slide plate and shoe for positioning the springs and the guide incorporates downwardly inclined guide members that receive the cut springs from the holder and position the springs in a stacked relationship. One of the elongated spring forming machines has its holder slide plate provided with horizontal and inclined portions and is specifically designed to position relatively long springs, while the other elongated spring forming machine has its holder slide plate provided with an inclined edge and the slide shoe provided with a positioning prong between the guide members in order to be capable of positioning relatively short springs.

9 Claims, 8 Drawing Figures

SPRING FORMING MACHINE

BACKGROUND OF THE INVENTION

1. Field of the Invention

This invention relates to machines that form wire from a continuous coil to include oppositely disposed loops and which have a cut-off mechanism for cutting the wire to provide springs of a selected length.

2. Description of the Prior Art

Machines of the type to which this invention relates are utilized to make either "sinuous" springs or "formed wire" springs. Sinuous springs have oppositely disposed loops with curved ends so as to provide a generally sinuous path of wire forming the spring. Formed wire springs have oppositely disposed square loops including straight wire portions joined by sharp angle bends. Both of these types of springs are utilized in seating applications to provide resilient support for seat padding between spaced seat frame members. Certain springs have a relatively high upwardly curved configuration extending between the frame members and are referred to as "high arc" springs. These high arc springs are deflected during assembly to attach opposite ends thereof to the frame members and have generally circular shapes in their undeflected state prior to this deflection. Other springs of this type have a relatively low degree of upward curvature extending between the frame members and have elongated shapes in their undeflected state of a relatively long length. Also, certain seat constructions incorporate elongated edge springs of a relatively short length adjacent the frame members to provide resilient support adjacent thereto with a lessened amount of padding.

Manufacturing of the type of wire springs discussed above is performed on machines like those disclosed by U.S. Pat. Nos. 2,188,406, 2,998,045, 3,071,168 and 3,172,431. Wire from a continuous coil is bent to form the spring loops during operation of these machines and is then cut by a cut-off mechanism after the bending to provide the completed spring. In the past, the machine operator has stood next to the machine and grasped the springs during operation of the cut-off mechanism as the springs are cut from the wire of the rest of the coil. Spring deflection and consequent rebounding movement as the wire is severed by the cut-off mechanism is thus prevented by the operator's manual grasp of the springs as he or she stands relatively close to the cut-off mechanism.

SUMMARY OF THE INVENTION

An object of the invention is to provide an improved spring for forming wire from a continuous coil to include oppositely disposed loops and having a holder for automatically locating the springs during operation of the machine cut-off mechanism to prevent spring deflection and consequent movement as the wire is cut as well as including a guide for orienting and delivering the cut springs to a location remote from the machine cut-off mechanism.

In carrying out the above object and other objects of the invention, three preferred embodiments of the machine are disclosed. One machine embodiment for manufacturing circular springs has its holder formed as a downwardly inclined chute and has its guide including a conveyor and deflection plates that lay the circular springs down flat on the conveyor after being received thereon from the chute. Two other preferred embodiments of the machine for manufacturing springs with elongated shapes each have their holder including a slide plate and a slide shoe between which the springs are located during the operation of the cut-off mechanism, and the guide of each of these machines includes elongated guide members spaced from each other in a parellel relationship inclined downwardly from the slide plate to receive and stack the cut springs as the springs slide down along the guide members under the bias of gravity.

The machine embodiment for manufacturing circular springs has the chute of its holder inclined downwardly on one side of the conveyor of the guide. During operation of the cut-off mechanism, the springs are received within the chute to prevent spring deflection and consequent movement as the wire is severed. Subsequently, the cut spring rolls downwardly through the chute onto the conveyor of the guide. A first deflection plate of the guide is oriented vertically parallel to the direction of conveyance and is located on the opposite side of the conveyor from the chute in alignment therewith so as to prevent the springs from rolling off the conveyor. A second deflection plate of the guide is located above the conveyor with an inclined orientation so as to engage the springs and ensure positioning thereof in the flat lying condition on the conveyor. A third deflection plate of the guide is oriented vertically on the same side of the conveyor as the chute across from the first deflection plate and prevents the springs from falling off the conveyor after being deflected by the first and second plates.

One of the two machine embodiments for manufacturing elongated springs has the slide plate of its holder provided with a horizontal portion and an inclined portion and is particularly adapted for manufacturing such springs of a relatively long length. Each elongated guide member of the machine guide extends downwardly from the inclined slide plate portion to receive the cut springs therefrom after operation of the cut-off mechanism. An upturned forward end of the slide shoe ensures positioning of the springs between the shoe and the horizontal portion of the slide plate as the cut-off mechanism severs the bent springs from the rest of the wire coil.

The other machine embodiment for manufacturing springs of elongated shapes has an inclined slide plate and shoe construction particularly adapted for manufacturing relatively short springs. Both the slide plate and the slide shoe are inclined relative to the horizontal and the slide shoe has an edge that is inclined relative to the elongated direction of the guide members that receive the springs after cutting. A component of the inclined slide plate edge faces toward the cut-off mechanism of the machine and ensures downward sliding of the cut springs from the slide plate onto the adjacent elongated guide members of the guide under the bias of gravity. A forward upturned end of the slide shoe engages each spring to ensure positioning of the spring between the slide plate and the shoe and a positioning prong on the slide shoe extends parallel to the guide members located therebetween to prevent upward spring movement as the springs are cut from the rest of the coil. Between the guide members of the guide adjacent the positioning prong, the inclined edge of the slide plate has an opening that has been found effective in ensuring spring movement to between the slide plate and the slide shoe and from there onto the guide members.

The objects, features and advantages of the present invention are readily apparent from the following detailed description of the preferred embodiments taken in connection with the accompanying drawings.

DETAILED DESCRIPTION OF THE PREFERRED EMBODIMENTS

Figure 1:
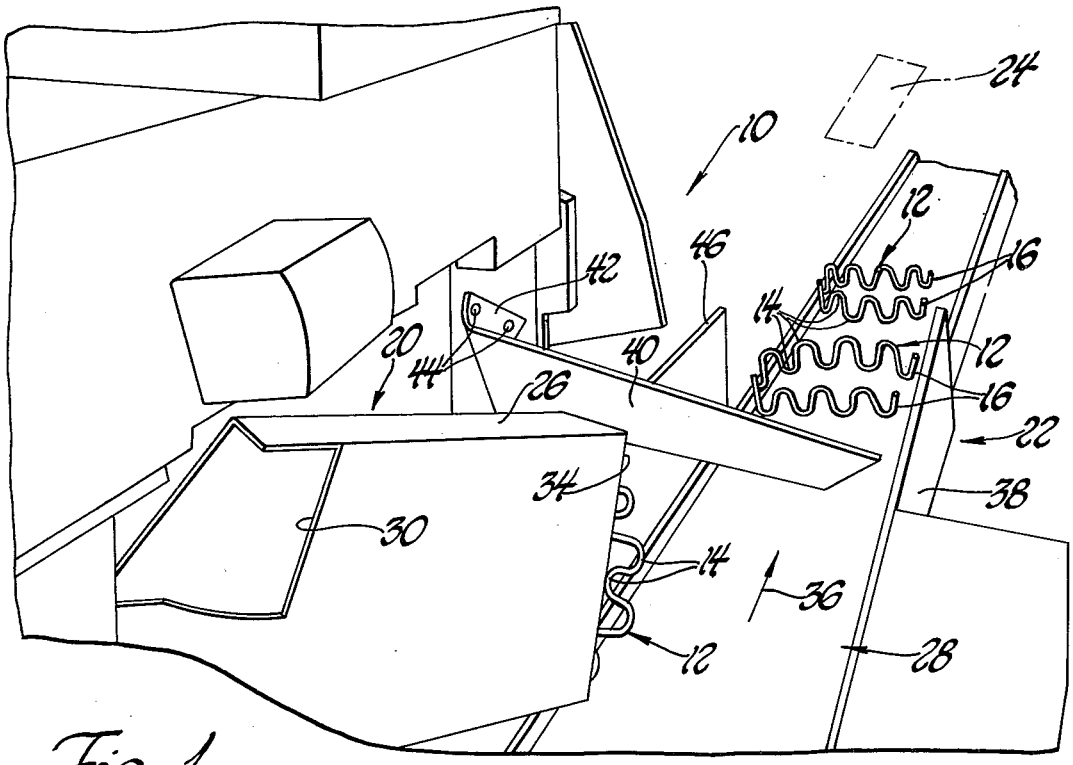
FIG. 1 is a perspective view of one preferred embodiment of the machine for making circular springs with oppositely disposed loops.
Figure 2:
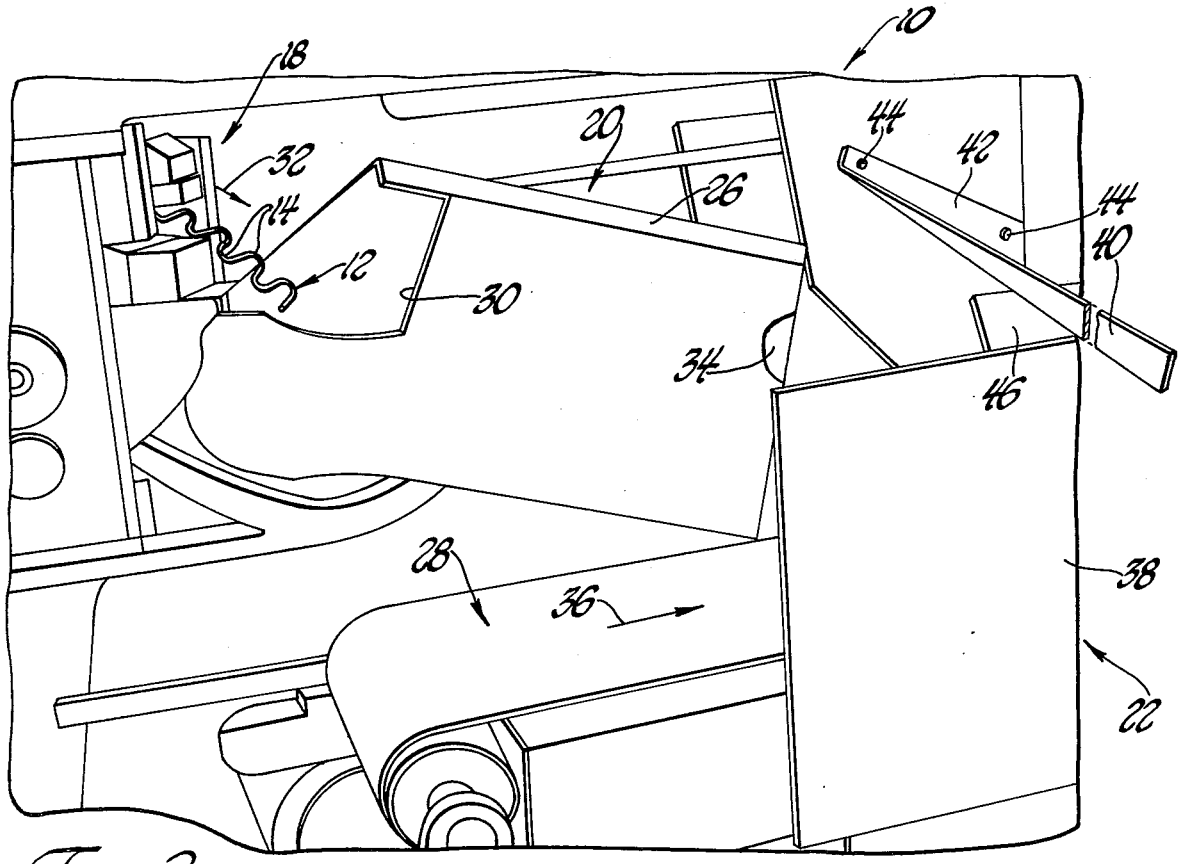
FIG. 2 is also a perspective view of the same machine embodiment as in FIG. 1 but taken from a slightly different angle.

Referring to FIGS. 1 and 2 of the drawings, one machine constructed according to the present invention is indicated collectively by 10 and includes a conventional unshown mechanism for bending wire from a continuous coil to provide circular sinuous springs 12 having oppositely disposed loops 14. Opposite ends 16 of each spring are designed for attachment to spaced frame members of a seat with which the spring is to be utilized. When assembled extending between the seat frame members, the springs 12 have a relatively pronounced curvature that extends upwardly from the frame members to give the seat a "high arc" construction as it is referred to by those involved in the seating art. To sever each spring from the wire of the rest of the coil, the machine includes a conventional cut-off mechanism 18 shown in FIG. 2. The cut-off mechanism may also form the spring ends with shapes that facilitate securement of the spring ends to the frame members by attachment clips. A holder 20 and a guide collectively indicated by 22 cooperate to deliver the cut springs 12 to a location remote from the cut-off mechanism 18, such as to the work station 24 shown by phantom line representation in FIG. 1.

Spring holder 20 includes a closed cross-section chute that is inclined downwardly located on one side of a conveyor 28 of the guide 22. Springs that have been bent by the machine 10 pass through the cut-off mechanism 18 as shown in FIG. 2 before becoming severed from the wire coil from which the springs are formed. An open upper end 30 of the holder chute 26 receives the circular springs as the bent wire passes through the cut-off mechanism 18 in the direction shown by arrow 32. Prior to operation of the cut-off mechanism 18, the spring is positioned within the upper chute end 30 sufficiently so that severing of the spring wire and any consequent spring deflection is prevented from causing spring movement by the closed rectangular cross-section of the chute.

After each spring 12 is cut from the wire coil by the cut-off mechanism 18, the spring rolls downwardly through the chute 26 to exit via its lower end 34 onto the conveyor 28. It should be noted that the chute is oriented in a slightly skewed relationship with respect to the direction of conveyance as shown by arrow 36 so that the springs roll along the conveyor in the same direction but across the conveyor as well. A first deflection plate 38 of the guide 22 is oriented in a vertical plane and is located on the opposite side of the conveyor 28 from the chute 26 in alignment with the direction in which the springs roll from the chute. Deflection plate 38 prevents the springs 12 from rolling off the conveyor 28 as the springs leave the chute and roll across the conveyor. A second deflection plate 40 of the guide has a bent end 42 secured to the machine by suitable fasteners 44 and has its plane positioned in an inclined orientation with respect to the conveyor 28 spaced sufficiently above the conveyor so that the springs can move under this plate when positioned in the flat lying condition shown in FIG. 1. The inclined deflection plate 40 is oriented extending downwardly in the direction of conveyance along arrow 36 so that this plate positions any springs 12 that may be standing on their edge downwardly in the flat lying condition as the spring passes under the plate. On the opposite side of the conveyor 28 from the first deflection plate 38, a third deflection plate 46 is mounted in a suitable manner with its plane extending vertically to prevent any springs deflecting off the other two plates from rolling off the conveyor.

Figure 3:
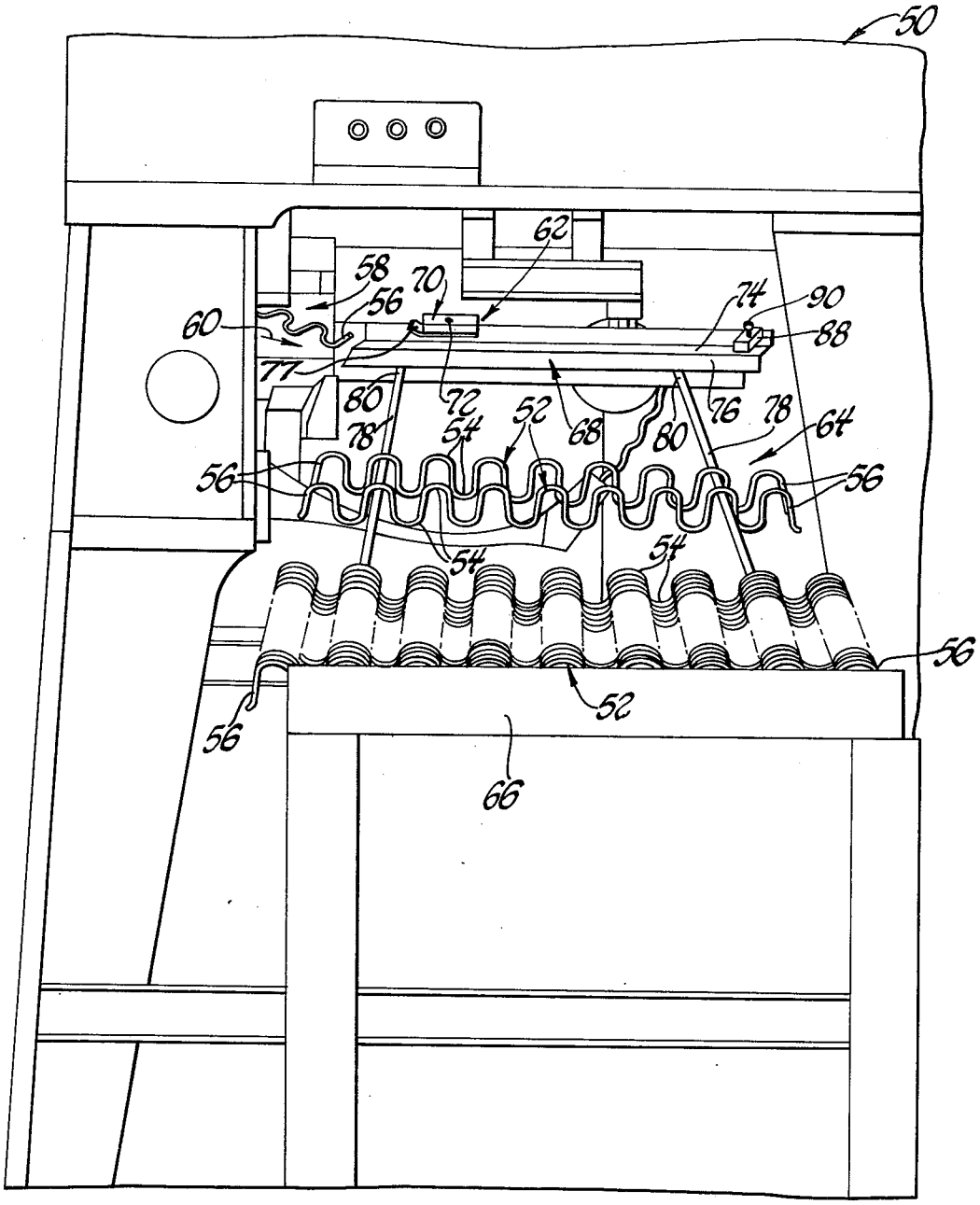
FIG. 3 is a perspective view of a machine embodiment for manufacturing relatively long elongated springs with oppositely disposed loops.
Figure 4:
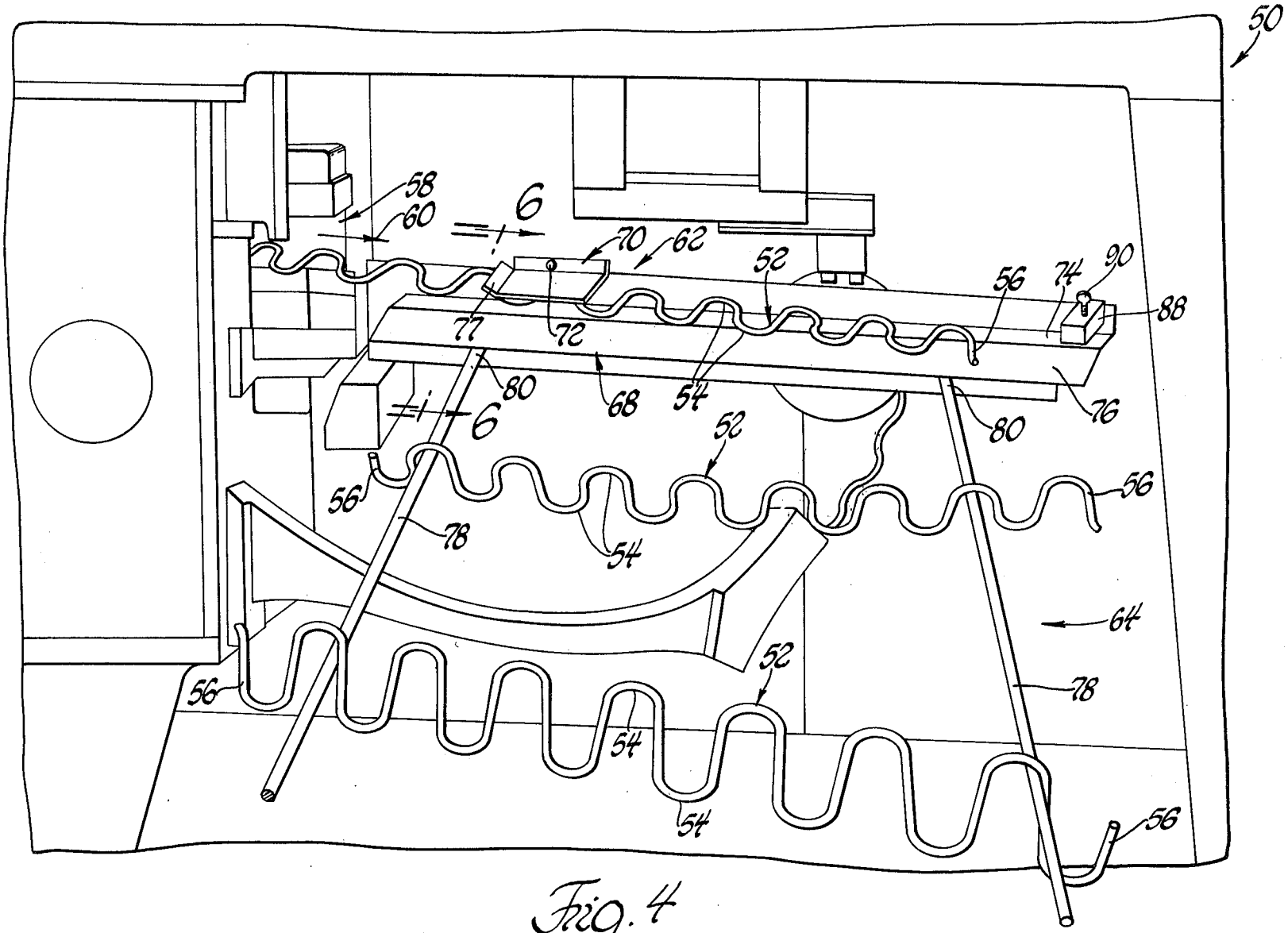
FIG. 4 is an enlarged portion of the perspective view shown by FIG. 3 but taken at a slightly different angle.

Another embodiment of a spring forming machine constructed according to the present invention is shown in FIGS. 3 and 4 and indicated collectively by numeral 50. Machine 50 includes conventional bending mechanism for forming relatively long springs 52 from a continuous coil of wire so as to include oppositely disposed loops 54 that give the springs generally sinuous configurations between their opposite ends 56. A conventional cut-off mechanism 58 of the machine severs the spring wire to provide the completed springs as the bent wire springs are fed outwardly along the direction of arrow 60. During operation of the cut-off mechanism, a holder collectively indicated by 62 prevents spring deflection and consequent spring movement. Subsequent to the cutting of the springs, each spring 52 is delivered to a guide collectively indicated by 64 for downward sliding movement under the bias of gravity to a location remote from the cut-off mechanism such as against the frame member 66 shown in FIG. 3. The springs 52 thus stack up against the frame member 66 as shown and await removal by a machine operator.

Figure 6:
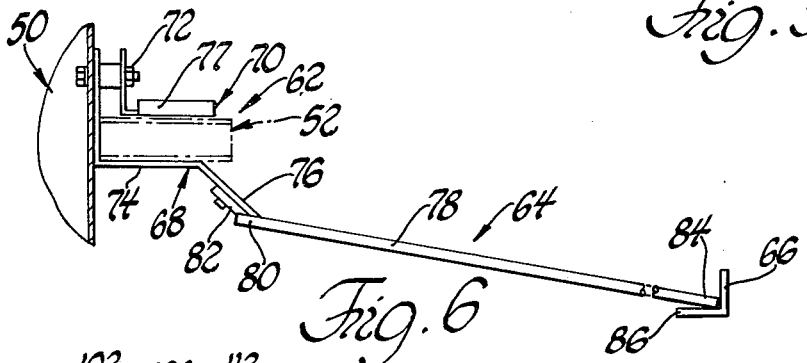
FIG. 6 is a sectional view of the FIGS. 3 and 4 machine embodiment and is taken along line 6—6 of FIG. 4.

With continuing reference to FIGS. 3 and 4 and reference to FIG. 6 as well, holder 62 includes a slide plate 68 along which the leading spring end 56 moves outwardly along the direction of arrow 60 as it is fed outwardly from the machine after bending. A slide shoe 70 of the holder is mounted on the machine 50 by a suitable connection 72 above the slide plate 68 and engages an intermediate portion of the spring as shown in FIG. 4 during operation of the cut-off mechanism. The spring curvature and positioning of the slide shoe 70 with respect to the slide plate 68 is such that the shoe presses downwardly against the spring to prevent upward spring movement as the spring wire is severed by the cut-off mechanism 58. Slide plate 68 has a horizontal portion 74 as well as an inclined portion 76 that extends downwardly toward the guide 64. Best results are achieved when the horizontal portion 74 has a width equal to approximately seventy-five percent of the width of the springs 52 between the closed ends of their oppositely disposed loops 54. With this relationship it has been found that the springs are positioned sufficiently during operation of the cut-off mechanism and yet are automatically delivered to the guide 64 after first sliding downwardly on the inclined plate portion 76. A front upturned end 77 of slide shoe 70 engages the spring 52 to ensure positioning thereof between the slide shoe and the horizontal plate portion 74.

The spring guide 64 is shown in FIGS. 3 and 4 as including a pair of elongated guide members 78 that extend parallel to each other perpendicular to the direction of spring movement along arrow 60 in a downwardly inclined relationship so that the springs slide against the frame member 66 under the bias of gravity as shown in FIG. 3. Each guide member 78 has an upper end 80 as shown in FIG. 6 that is secured to the lower side of the inclined plate portion 76 by an adjustable connector 82 so that the guide members can be positioned along the length of the slide plate in an adjustable fashion. This adjustable positioning permits the machine to manufacture springs during different production runs with the spring loops thereof of different spacings along the length of the springs. A lower end 84 of each guide member 78 is supported by an inwardly extending flange 86 of frame member 66 as shown in FIG. 6.

Also, a stop 88 of machine 50 is adjustably secured to the slide plate 68 by a thumb screw 90 or any other suitable means. Engagement of the stop 88 with the leading spring end 56 limits spring movement as the springs slide between the slide plate 68 and the slide shoe 70. Adjustment of the stop location along the slide shoe permits springs of different lengths to be manufactured.

Figure 5:
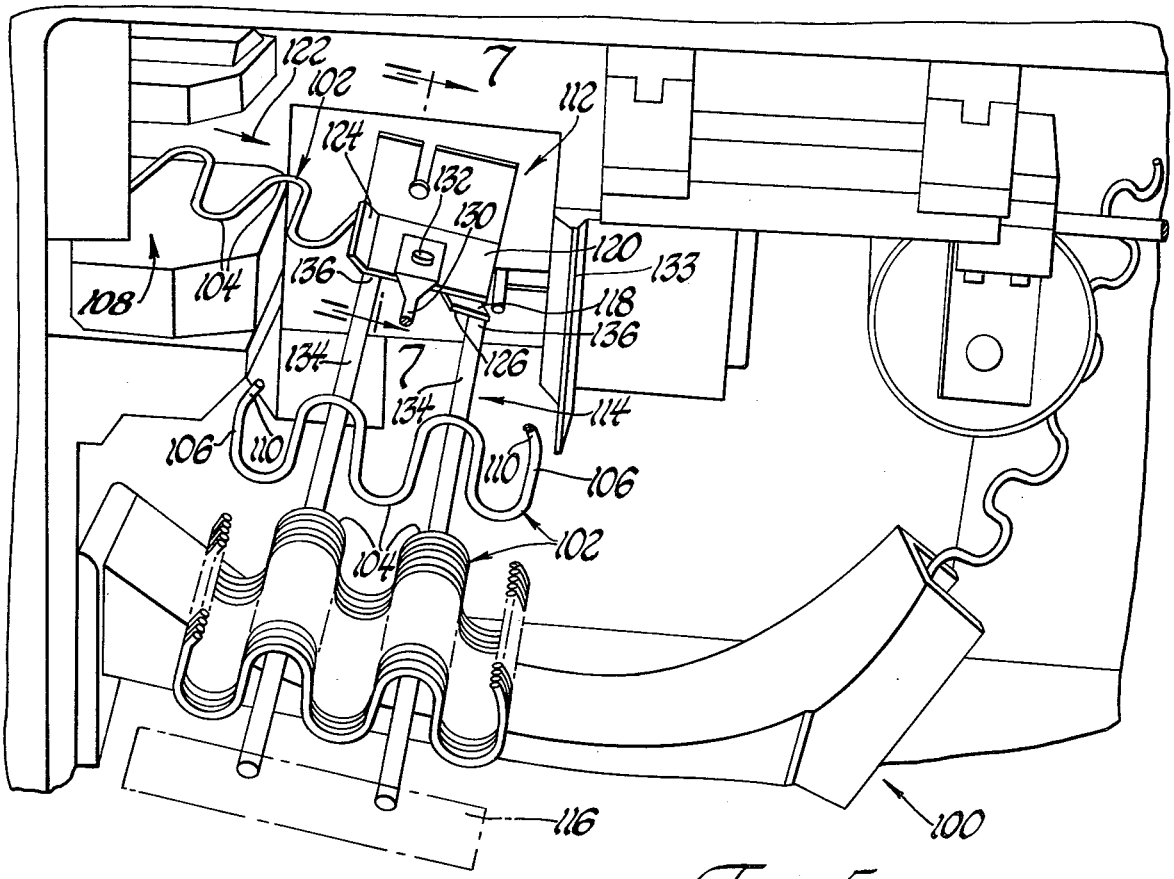
FIG. 5 is a perspective view of a machine embodiment for manufacturing relatively short elongated springs.

FIG. 5 shows another machine 100 for forming springs 102 from a continuous coil of wire so as to include oppositely disposed loops 104 that give the springs sinuous configurations between their opposite ends 106. A conventional cut-off mechanism 108 of the machine severs the spring wire to complete the spring manufacturing operation. It should be noted that each spring end 106 may be formed with an inwardly turned portion 110 to facilitate retainer clip attachment that secures the spring ends during attachment to a seat with which the spring is utilized. A holder 112 locates the springs 102 during operation of the cut-off mechanism 108 so as to prevent spring deflection and consequent movement as the spring wire is severed. After each spring has been cut, a guide 114 receives the spring to permit it to slide downwardly under the bias of gravity so as to be located at a remote location in a stacked relationship with the other springs such as against the phantom line indicated frame member 116.

Figure 7:
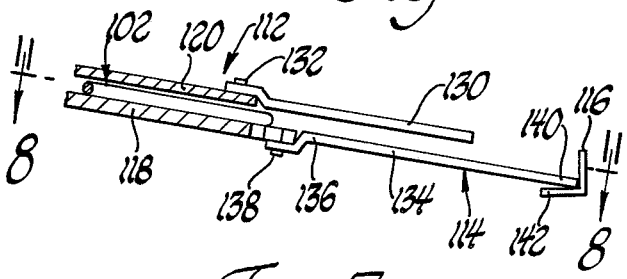
FIG. 7 is a sectional view taken along line 7—7 of FIG. 5 to show the machine embodiment thereof.
Figure 8:
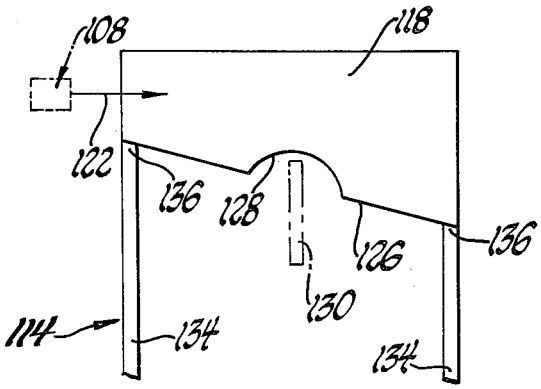
FIG. 8 is a slightly inclined plan view taken along line 8—8 of FIG. 7.

Spring holder 112 is shown in FIGS. 5 and 7 as including an inclined slide plate 118 and an inclined slide shoe 120. Springs 102 are received between the slide plate 118 and the slide shoe 120 as the springs exit from the machine along the direction of arrow 122 shown in FIG. 5. A front upturned end 124 of the slide shoe 120 ensures positioning of the spring between the shoe and the plate 118 as shown in FIG. 7. Slide plate 118 has an edge 126, see FIG. 8, that is inclined with respect to the direction of spring movement along arrow 122 and has a component partially facing the spring cut-off mechanism 108. It has been found that this inclined edge 126 of the slide plate is helpful in ensuring downward movement of the springs from the holder 120 to the guide 114 subsequent to cutting. Providing an opening 128 along the inclined edge has also been found helpful in this regard. Slide shoe 120 includes a positioning prong 130 secured to the shoe by a connection 132 and extending outwardly adjacent the plate edge opening 128 in the same direction as the guide 114 so as to prevent upward spring movement during the spring cutting operation.

A stop 133 of machine 100 engages the leading spring end 106 to limit movement of the springs 102 as they slide between plate 118 and shoe 120. Since short springs of this type used at edge locations are usually of the same length, there is no necessity for stop 133 to be adjustable, but it could be so if required to accommodate springs of different lengths.

As seen in FIG. 5, spring guide 114 includes a pair of elongated guide members 134 extending outwardly and downwardly from the slide plate 118 in a parallel relationship to each other on opposite sides of the shoe positioning prong 130. Each guide member has an inner end 136, FIG. 7, secured to the lower side of slide plate 118 by an adjustable connection 138 and an outer end 140 that rests on a flange 142 of the frame member 116. Adjustment of the guide members 134 along the slide plate 118 in the direction of the arrow 122 permits the springs being manufactured to have their loops spaced at varying distances along the length of each spring.

While preferred embodiments of the spring forming machine have herein been described in detail, those familiar with the art will recognize various alternative designs and embodiments for practicing the present invention as defined by the following claims.

What is claimed is:

1. In a machine for forming wire from a continuous wire coil to include oppositely disposed loops and having a cut-off mechanism for cutting the wire to provide springs of a selected length and a width which is determined by the size of the loops, the improvement comprising: a holder for locating the springs during operation of the cut-off mechanism to prevent spring deflection and consequent movement as the wire is cut; the holder including upper and lower spaced surfaces between which the spring loops are slidably received; the lower surface including at least a portion which is inclined so that the cut spring slides down under gravity from between the upper and lower surfaces; and a guide for receiving the cut springs from the holder to orient and deliver the springs to a location remote from the machine cut-off mechanism.

2. In a machine for forming wire from a continuous wire coil to include oppositely disposed loops and having a cut-off mechanism for cutting the wire to provide springs of a selected length, the improvement comprising: a holder for locating the springs during operation of the cut-off mechanism to prevent spring deflection and consequent movement as the wire is cut; the holder including a slide plate and a slide shoe spaced from the slide plate to receive the springs therebetween and thereby position the springs during operation of the cut-off mechanism; said slide plate including at least a portion having an inclined orientation; a guide for orienting and delivering the cut springs to a location remote from the machine cut-off mechanism; and the guide including elongated guide members spaced from each other in a generally parallel relationship and inclined downwardly extending away from the slide plate and the slide shoe to receive the cut springs from the inclined portion of the slide plate and provide stacking thereof under the bias of gravity.

3. A machine as in claim 2 wherein the slide plate includes an edge that is inclined relative to the elongated directions of the guide members and has a component that faces toward the cut-off mechanism.

4. A machine as in claim 3 wherein the slide shoe is inclined in an orientation parallel to the slide plate and includes a forward upturned end that ensures positioning of each spring between the slide plate and the shoe during operation of the cut-off mechanism, and the shoe also including a positioning prong extending parallel to the guide members located therebetween to prevent upward spring movement during operation of the cut-off mechanism.

5. A machine as in claim 4 wherein the inclined edge of the slide plate includes an opening between the guide members adjacent the positioning prong.

6. A machine as in claim 2 further including a stop that engages each spring to limit movement thereof as the spring is received between the slide plate and the slide shoe.

7. In a machine for forming wire from a continuous wire coil to include oppositely disposed loops and having a cut-off mechanism for cutting the wire to provide springs of a selected length, the improvement comprising: a holder for locating the springs during operation of the cut-off mechanism to prevent spring deflection and consequent movement as the wire is cut; the holder including a slide plate and a slide shoe spaced from the slide plate to receive the springs therebetween and thereby position the springs during operation of the cut-off mechanism; the slide plate of the holder including a horizontal portion and an inclined portion extending downwardly from the horizontal portion to the elongated guide members; the slide shoe having a front upturned end that ensures positioning of each spring between the horizontal portion of the slide plate and the shoe during operation of the cut-off mechanism; a guide for orienting and delivering the cut springs to a location remote from the machine cut-off mechanism; and the guide including elongated guide members spaced from each other in a generally parallel relationship and inclined downwardly extending away from the slide plate and the slide shoe to receive the cut springs under the bias of gravity.

8. A machine for forming wire from a continuous wire coil to include oppositely disposed loops defining an elongated spring shape and having a cut-off mechanism for cutting the wire to provide elongated springs of a selected length, the improvement comprising: a holder including a slide plate and a slide shoe spaced above the slide shoe to receive and position the springs therebetween during operation of the cut-off mechanism; said slide plate having a horizontal portion and an inclined portion extending downwardly from the horizontal portion; a stop that engages each spring to limit movement thereof as the spring is received between the slide plate and the slide shoe; and a guide including a pair of elongated guide members extending downwardly from the inclined portion of the slide plate in a parallel relationship to each other to receive springs from the holder and provide stacking of the springs under the bias of gravity at a location remote from the machine cut-off mechanism.

9. A machine for forming wire from a continuous wire coil to include oppositely disposed loops defining an elongated spring shape and having a cut-off mechanism for cutting the wire to provide elongated springs of a selected length, the improvement comprising: a holder including an inclined slide plate and an inclined slide shoe spaced above the slide plate to receive and position the springs therebetween during operation of the cut-off mechanism; said slide plate having an edge that is inclined relative to the elongated extent of the springs positioned thereby facing partially toward the cut-off mechanism; the inclined shoe having a positioning prong that extends therefrom to prevent upward spring movement during operation of the cut-off mechanism; a stop that engages each spring to limit movement thereof as the spring is received between the slide plate and the slide shoe; and a guide including a pair of elongated guide members extending outwardly and downwardly from the inclined slide plate on opposite sides of the positioning prong parallel to each other so as to receive cut springs from the holder and provide stacking of the springs under the bias of gravity at a location remote from the cut-off mechanism.

* * * * *